US006532965B1

(12) United States Patent
Abhulimen et al.

(10) Patent No.: US 6,532,965 B1
(45) Date of Patent: Mar. 18, 2003

(54) SMOKING ARTICLE USING STEAM AS AN AEROSOL-GENERATING SOURCE

(75) Inventors: Michael E. Abhulimen, Macon, GA (US); Kayyani C. Adiga, Macon, GA (US); Rufus H. Honeycutt, Kathleen, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/045,922

(22) Filed: Oct. 24, 2001

(51) Int. Cl.[7] ..... A24F 13/04

(52) U.S. Cl. ..... 131/194; 131/351; 131/185; 131/175; 131/187; 131/178; 131/329; 131/361; 431/253

(58) Field of Search ..... 131/185, 351, 131/175, 187, 178, 198.1, 191, 361, 329, 194; 431/253, 267, 270

(56) References Cited

U.S. PATENT DOCUMENTS

| | | | | |
|---|---|---|---|---|
| 2,549,726 | A | 4/1951 | Van Toll | |
| 2,549,727 | A | 4/1951 | Van Toll | |
| 2,721,558 | A | * 10/1955 | Griffiths | 131/351 |
| 3,631,856 | A | 1/1972 | Taylor | |
| 3,698,400 | A | 10/1972 | Tucker | |
| 4,171,000 | A | 10/1979 | Uhle | |
| 4,216,786 | A | 8/1980 | Wright | |
| 4,223,687 | A | 9/1980 | Sandeen | |
| 4,276,892 | A | 7/1981 | Iaquinta | |
| 4,393,884 | A | 7/1983 | Jacobs | |
| 4,774,970 | A | 10/1988 | Bell | |
| 4,793,365 | A | 12/1988 | Sensabaugh, Jr. et al. | |
| 4,819,665 | A | 4/1989 | Roberts et al. | |
| 4,848,374 | A | 7/1989 | Chard et al. | |
| 4,892,109 | A | 1/1990 | Strubel | |
| 4,945,931 | A | 8/1990 | Gori | |
| 5,098,283 | A | 3/1992 | Clapp | |
| 5,247,947 | A | 9/1993 | Clearman et al. | |
| 5,535,735 | A | 7/1996 | McPherson | |
| 5,549,124 | A | 8/1996 | Dorsey | |
| 5,944,025 | A | 8/1999 | Cook et al. | |
| 5,984,669 | A | 11/1999 | Rosada et al. | |

* cited by examiner

*Primary Examiner*—Steven P. Griffin
*Assistant Examiner*—Dionne A. Walls
(74) *Attorney, Agent, or Firm*—Charles G. Lamb; Middleton Reutlinger

(57) ABSTRACT

A non-burning cigarette holder is comprised of an upstream cylindrical section of a low heat conducting material and a downstream cylindrical section of a relatively high heat conducting material. The upstream cylindrical section has a first upstream chamber for receiving a fuel source and a second downstream chamber defining a fuel mixture chamber which is in flow communication with the first upstream chamber. The downstream cylindrical section is provided with a flame holder downstream of the chamber and a flame chamber is disposed between the flame holder and a cigarette receiving chamber adapted to receive a tobacco rod or a cigarette. The fuel source may be an ethanol-water mixture disposed within the upstream cylindrical section or the fuel source may be attached to the upstream end of the upstream cylindrical section.

26 Claims, 1 Drawing Sheet

SMOKING ARTICLE USING STEAM AS AN AEROSOL-GENERATING SOURCE

BACKGROUND OF THE INVENTION

The present invention relates to a simulated smoking article and more particularly to a non-combustible simulated smoking device using steam as an aerosol-generating source.

Various proposals have been made to provide a simulated smoking article which provides a tobacco taste without the combustion of tobacco. For example, U.S. Pat. No. 5,944,025 to Cook et al teaches a smoking article wherein hot gases are generated in a catalytic section of the smoking article which are used to form flavorable aerosol gases delivered to a smoker's mouth while controlling the composition of the gases of combustion. U.S. Pat. No. 4,892,109 to Strubel teaches a simulated smoking article which utilizes chemical reactants which exothermically react when mixed together to provide a heat source for heating aerosol-generating substances which are drawn into the mouth of a smoker. Also, U.S. Pat. No. 5,247,947 to Clearman et al; U.S. Pat. No. 4,819,665 to Roberts et al; and, U.S. Pat. No. 4,793,365 to Sensabaugh, Jr. et al teach various simulated smoking articles in which a heated aerosol is produced from an external heat source that is then delivered to the smoker.

SUMMARY OF THE INVENTION

It is an object of the present invention to provide a non-burning cigarette holder for receiving a cigarette therein wherein the tobacco in the cigarette is heated with steam and the flavorants in the tobacco are vaporized and maintained in a steam aerosol for ingestion by the smoker.

It is another object of the present invention to provide a non-burning cigarette holder for receiving a cigarette therein using an ethanol-water mixture as a fuel source for vaporizing the flavorants in a cigarette or tobacco column received within the holder.

In the instant invention, a non-burning cigarette holder is is attached to an ethanol-water fuel mixture wherein the fuel mixture is mixed with an air supply and ignited with heated gases and vapors which evolve therefrom being passed through a tobacco column of a cigarette wherein the tobacco within the cigarette is heated without combusting and the heated tobacco releases flavors into the hot vapors which are ingested by a smoker.

More particularly, the present invention is directed to a non-burning cigarette holder which includes a housing having an upstream section of a low-heat conducting material and a downstream section which is designed to receive a cigarette therein. The upstream section is provided with a first upstream chamber for receiving a fuel source therein and a second downstream chamber defining a fuel mixture chamber in flow communication with the upstream chamber. The downstream section includes a flame holder downstream of the second chamber and a flame chamber disposed between the flame holder and a downstream cigarette receiving chamber within the downstream section. The fuel source is an ethanol-water mixture.

BRIEF DESCRIPTION OF THE DRAWINGS

A better understanding of the invention will be had upon reference to the following description in conjunction with the accompanying drawings wherein like numerals refer to like parts throughout the views and in which.

DETAILED DESCRIPTION OF THE PREFERRED EMBODIMENTS

Figure 2:
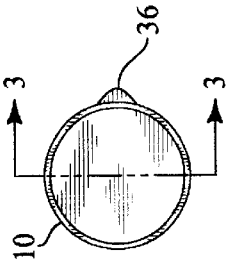
FIG. 2 is an end view of the preferred embodiment of FIG. 1.
Figure 1:
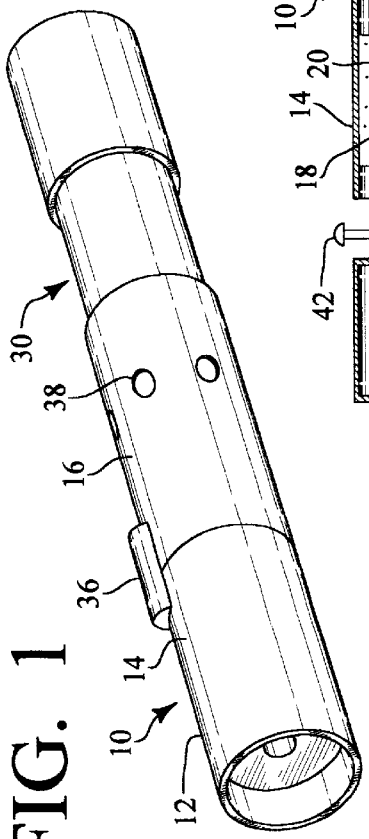
FIG. 1 is a perspective view of a first preferred embodiment of a non-burning cigarette holder of the present invention with a cigarette received therein.

With reference to the Figures, there is shown a non-burning cigarette holder, generally denoted as the numeral 10, of the present invention. As can be best seen in FIG. 1, the non-burning cigarette holder 10 includes a housing 12 which includes an upstream tubular section 14 and a downstream tubular section 16. The upstream tubular section 14 is usually of a low heat conducting material, such as a ceramic, and the downstream tubular section 16 is generally a metal tube of a high heat conducting material, such as aluminum. Also, as shown in FIG. 1, a cigarette identified by the numeral 30 is inserted into the downstream tubular section 16. Also, as shown in FIGS. 1 and 2, attached to the housing 12 generally adjacent the connection of the upstream tubular section 14 with the downstream tubular section 16 is a spark igniter 36 which may be a piezo spark or battery operated heating element or any other spark ignitor known in the art.

Figure 3:
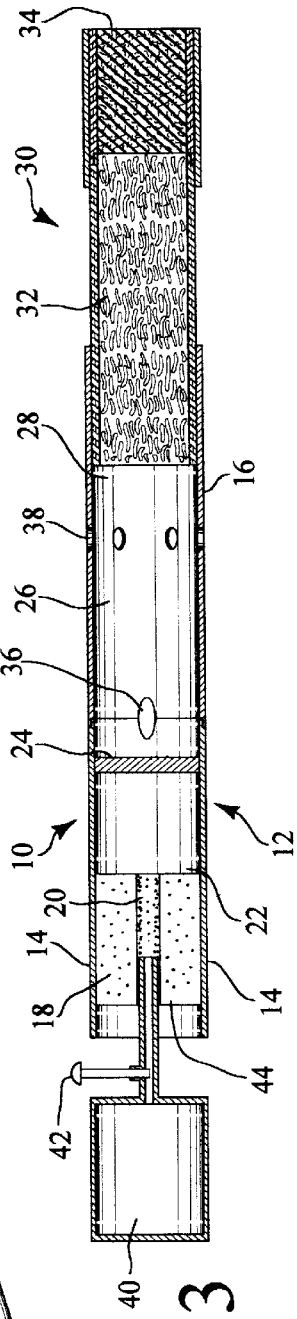
FIG. 3 is a longitudinal cross-sectional view of the first embodiment as seen in the direction of arrows 3—3 as shown in FIG. 2.

In FIG. 3 is shown a first preferred embodiment of the present invention which has attached at the upstream end of the upstream tubular section 14 a reusable pressurized air cartridge 40 with a control valve 42 for the control of the flow of air to the first upstream chamber 18. The first upstream chamber 18 includes a porous medium 44 which is soaked with an ethanol-water mixture, the porous medium 44 being formed of a substantially non-burning material, such as carbon fiber or cellulose acetate. The fuel mixture or second downstream chamber 22 is provided downstream of the porous medium 44 for receipt of premixed ethanol-water vapor and air generated by the flow of pressurized combustion air from the air cartridge 40. An air passageway 20 is generally provided in the porous medium 44 in flow communication with the outlet from the control valve 42 so that the combustion air passing through the passageway 20 picks up the ethanol-water vapor mixture from the porous medium 44. Adjacent to the interface of the upstream section 14 and the downstream section 16 is a flame holder 24, flame holder 24 being upstream of the flame or spark igniter 36. The downstream tubular section 16, as shown in the embodiment of FIG. 3, is provided with puffing air holes 38 which are positioned to be just upstream of the upstream tobacco end of the cigarette 30 which is received within the cigarette receiving chamber 28 of the downstream tubular section 16. As shown in FIG. 3, the cigarette 30 is provided with a tobacco end 32 and a filter end 34.

In the use of the invention as shown in the first embodiment in FIG. 3, the smoking device of the instant invention uses the combustion of a mixture of ethanol vapor and air to produce a flame in the flame chamber 26. The ethanol fuel, which also contains water, is stored in the porous medium 44. The porous medium 44 formed of a non-burning material, such as carbon fibers or cellulose acetate, includes the passageway 20 which is generally 2–3 mm diameter through which the air from the cartridge 40 passes. The ethanol fuel is picked up from the air drawn through the porous medium 44 and is then ignited downstream at the flame holder 24. The ignition of the ethanol-air mixture is generally accomplished with a piezo spark or battery-operated heating element or igniter 36. The flame formed produces a hot mixture of combustion gases and steam, which is in thermal equilibrium with the hot gases. Steam then condenses downstream of the flame holder 26 wherein an aerosol is thereby produced. A cigarette or tobacco rod disposed within the downstream tubular section 16 in the cigarette receiving chamber 38 is heated by the hot gases and the steam/aerosol as well as by the heated metal downstream tubular section 16 through which the combustion gases travel and in which the cigarette 30 is disposed. The aerosol is carried further downstream by the puffing action of the user wherein puffing air is brought in through puffing air openings 38, the aerosol/puffing air mixture picking up flavorants from the heated tobacco contained within the tobacco column 32. These flavorants are then, in turn, carried by the aerosol to the user's mouth. Preferably, the metal tube, particularly aluminum is used as the downstream tubular section 16 and is sufficiently hot that steam will not condense along its inner walls and interfere with the effectiveness of the aerosol carrier used to transport the tobacco flavors to the user.

Figure 4:
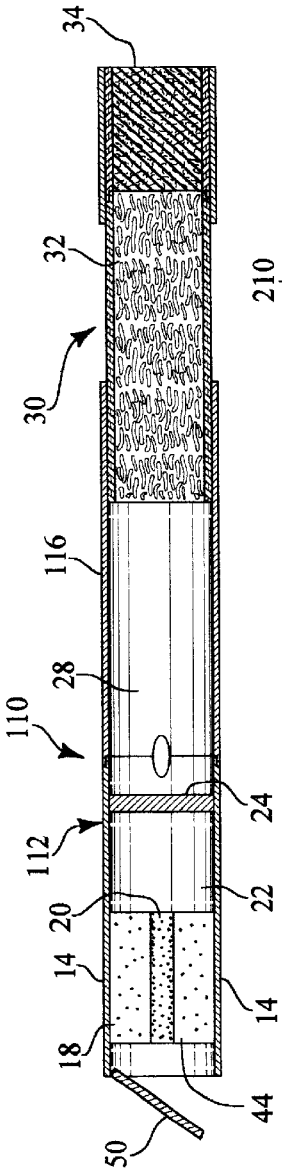
FIG. 4 is a longitudinal cross-sectional view of a second preferred embodiment of a non-burning cigarette holder of the present invention; and, FIG. 5 is a longitudinal cross-sectional view of a third preferred embodiment of the present invention.

In FIG. 4 is a second preferred embodiment of the present invention and varies from the first embodiment as shown in FIG. 3 in that the pressurized air cartridge 40 and control value 42 have been removed and in place thereof is a hinged lid 50 on the upstream end of housing 112. Moreover, the housing 112 is provided with the upstream tubular section 14 as shown in FIG. 3, but a downstream tubular section 116 replaces the downstream tubular section 16. In downstream section 116, the puffing air holes 38 are not included and all of the combustion air and the puffing air enter through the upstream end of the housing 112 upon the opening of the lid 50. In the operation of the embodiment of FIG. 4, upon ignition of the flame at the flame holder 24, the lid 50 must be raised to let the flow of air into the flame chamber so the flame is maintained by the puffing of the smoker.

Figure 5:
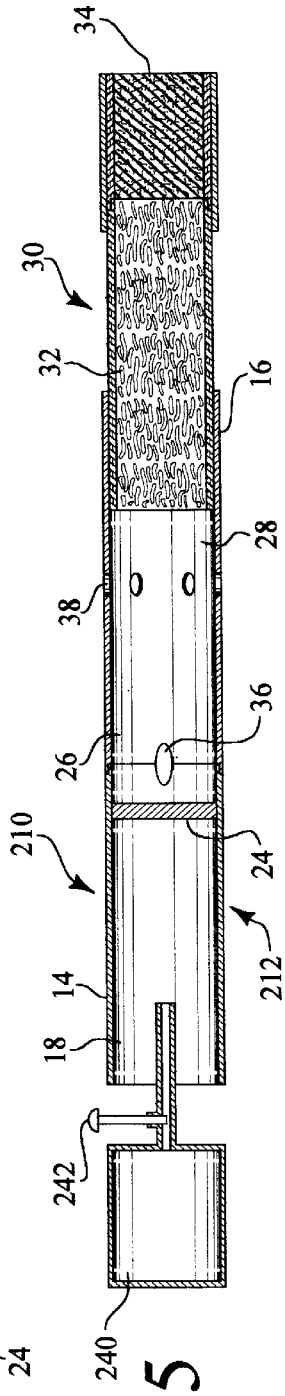

In the third embodiment, as shown in FIG. 5, the cigarette holder 210 is provided with a housing 212 which includes the upstream tubular section 14 and the downstream tubular section 16 wherein the first upstream chamber 18 does not include a porous medium 44 as provided in the embodiments shown in FIGS. 3 and 4. In this embodiment a reusable pressurized liquid fuel cartridge 240, which generally includes ethanol-water and air, is attached to the cigarette holder 210 and a mass control valve 242 is disposed in a connection between the cartridge 240 and the holder 210 to provide the controlled amount of a premixed ethanol-water and air mixture into the upstream chamber 18. In use, a controlled amount of the premixed ethanol-water vapor and air from the cartridge 240 mixes in the upstream chamber 18 and is then ignited at the flame holder 24 by the igniter 36.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A non-burning cigarette holder comprising:

a housing including an upstream cylindrical section of a low-heat conducting material and a downstream cylindrical section of high heat conducting material;

said upstream section having a first upstream chamber for receiving a fuel source and a second downstream chamber defining a fuel mixture chamber in flow communication with said first upstream chamber;

said downstream section having a flame holder downstream of said second downstream chamber and a flame chamber disposed between said flame holder and a cigarette receiving chamber.

2. The cigarette holder of claim 1, said first upstream chamber having a porous medium therein.

3. The cigarette holder of claim 2, said porous medium including fuel.

4. The cigarette holder of claim 3, said fuel being ethanol and water.

5. The cigarette holder of claim 3 including a pressurized air cartridge attached to an upstream end of said upstream section in flow communication with said fuel in said porous medium.

6. The cigarette holder of claim 3 including puffing air openings into said downstream cylindrical section.

7. The cigarette holder of claim 1, said upstream cylindrical section being a ceramic material and said downstream cylindrical section being a metal.

8. The cigarette holder of claim 7, said metal being aluminum.

9. The cigarette holder of claim 1 including a lid on an upstream end of said upstream cylindrical section.

10. The cigarette holder of claim 1 including a pressurized fuel cartridge attached to an upstream end of said upstream cylindrical section in flow communication with said upstream cylindrical section.

11. The cigarette holder of claim 10, said fuel being a mixture of ethanol and water.

12. The cigarette holder of claim 1 including a spark ignitor located in the region on the flame chamber downstream of the flame holder.

13. The holder of claim 12 wherein said spark ignitor is a piezo spark ignitor.

14. The cigarette holder of claim 12 wherein said spark ignitor is a battery operated heating element.

15. The cigarette holder of claim 1 wherein said flame chamber is provided with air puffing holes.

16. A non-burning cigarette holder comprising:

a housing including an upstream cylindrical section of a low-heat conducting material and a downstream cylindrical section of high heat conducting material, said upstream section having a first upstream chamber for receiving a fuel source, said first upstream chamber having a porous medium therein said porous medium including fuel, and a second downstream chamber defining a fuel mixture chamber in flow communication with said first upstream chamber;

said downstream section having a flame holder downstream of said second downstream chamber and a flame chamber disposed between said flame holder and a cigarette receiving chamber.

17. The cigarette holder of claim 16 including a spark ignitor located in the region of the flame chamber downstream of the flame holder.

18. The cigarette holder of claim 17, said spark ignitor being a piezo spark ignitor.

19. The cigarette holder of claim 17, said spark ignitor being a battery operated heating element.

20. The cigarette holder of claim 16, said flame chamber being provided with air puffing holes.

21. A non-burning cigarette holder comprising:

a housing including an upstream cylindrical section of a low-heat conducting material and a downstream cylindrical section of high heat conducting material, said upstream section having a first upstream chamber for receiving a fuel source, said first upstream chamber having a porous medium therein said porous medium including fuel and further including an air cartridge attached to an upstream end of said upstream section in flow communication with said fuel in said porous medium, and a second downstream chamber defining a fuel mixture chamber in flow communication with said first upstream chamber;

said downstream section having a flame holder downstream of said second downstream chamber and a flame chamber disposed between said flame holder and a cigarette receiving chamber.

22. The cigarette holder of claim 21 including a spark ignitor located in the region of the flame chamber downstream of the flame holder.

23. The cigarette holder of claim 20, said spark ignitor being a piezo spark ignitor.

24. The cigarette holder of claim 20, said spark ignitor being a battery operated heating element.

25. The cigarette holder of claim 21, said flame chamber being provided with air puffing holes.

26. A non-burning cigarette holder comprising:

a housing including an upstream cylindrical section of a low-heat conducting material and a downstream cylindrical section of high heat conducting material;

said upstream section having a first upstream chamber for receiving a fuel source and a second downstream chamber defining a fuel mixture chamber in flow communication with said first upstream chamber;

said downstream section having a flame holder downstream of said second downstream chamber and a flame chamber disposed between said flame holder and a cigarette receiving chamber;

a pressurized fuel cartridge attached to an upstream end of said upstream cylindrical section in flow communication with said upstream cylindrical section.

* * * * *